US007356265B2

(12) United States Patent
Kawai et al.

(10) Patent No.: US 7,356,265 B2
(45) Date of Patent: Apr. 8, 2008

(54) IMAGE FORMING APPARATUS

(75) Inventors: Atsushi Kawai, Toyokawa (JP); Tatsutoshi Yamada, Toyokawa (JP); Yoshihiko Yoshizaki, Aichi-ken (JP); Kazuo Okunishi, Okazaki (JP); Hideo Mae, Okazaki (JP); Yoshiaki Takano, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 68 days.

(21) Appl. No.: 11/386,702

(22) Filed: Mar. 23, 2006

(65) Prior Publication Data

US 2006/0294415 A1 Dec. 28, 2006

(30) Foreign Application Priority Data

Jun. 22, 2005 (JP) ..... 2005-181874

(51) Int. Cl.
*G03G 15/00* (2006.01)

(52) U.S. Cl. ..... 399/12; 399/25; 399/109

(58) Field of Classification Search ..... 399/12, 399/13, 25, 109, 111
See application file for complete search history.

(56) References Cited

U.S. PATENT DOCUMENTS 5,596,388 A * 1/1997 Ohkubo et al. ..... 399/111
5,701,402 A 12/1997 Miyamoto et al.
6,490,422 B2 * 12/2002 Harumoto ..... 399/12 X
6,807,380 B2 * 10/2004 Iida et al. ..... 399/12
7,130,559 B2 * 10/2006 Kimura et al. ..... 399/109

FOREIGN PATENT DOCUMENTS

JP 9-185236 7/1997

* cited by examiner

*Primary Examiner*—Sandra L. Brase
(74) *Attorney, Agent, or Firm*—Morrison & Foerster LLP

(57) ABSTRACT

An image forming apparatus in which the consumption article can be attached to and detached from a main body has a controller, which reads first new/old information that is stored in a repetitively rewritable area of a memory provided on the consumption article and represents whether or not the consumption article is unused after manufacturing or after recycling and second new/old information that is stored in a once rewritable area of the memory and represents the number of times of recycling of the consumption article and controls the operation of the image forming apparatus on the basis of the first new/old information and the second new/old information.

17 Claims, 5 Drawing Sheets

*Fig. 3*

| ADDRESS | KIND OF DATA STORAGE | MEMORY ATTRIBUTE |
|---|---|---|
| 00h<br>~<br>1Fh | MODEL IDENTIFICATION CODE<br>COLOR IDENTIFICATION CODE<br>LOADING WEIGHT IDENTIFICATION CODE | ONLY REDABLE<br>(ROM REGION) |
| 20h<br>~<br>2Fh | PRINTING OPERATION STATUS<br>FIRST NEW/OLD INFORMATION | READABLE/WRITABLE<br>(R/W REGION) |
| 30h<br>~<br>3Fh | USE HISTRY DATA<br>SECOND NEW/OLD INFORMATION | ONCE WRITABLE<br>(OTP REGION) |

*Fig. 4*

| FIRST NEW/OLD INFORMATION (R/W REGION) | SECOND NEW/OLD INFORMATION (OTP REGION) | PROCESSING |
|---|---|---|
| FFh | FFh | ·FIRST NEW/OLD INFORMATION IS WRITTEN TO "00h"<br>·LEAST SIGNIFICANT BIT OF SECOND NEW/OLD INFORMATION IS WRITTEN FROM "1" TO "0"<br>·NEW ARTICLE REPLACEMENT COUNTER IS INCREMENTED<br>·TONER EMPTY CANCEL TROUBLE THRESHOLD IS SET TO TWO |
| FFh | 01h<br>~<br>FEh | ·FIRST NEW/OLD INFORMATION IS WRITTEN TO "00h"<br>·LEAST SIGNIFICANT BIT OB SECOND NEW/OLD INFORMATION IS WRITTEN FROM "1" TO "0"<br>·RECYCLED ARTICLE REPLACEMENT COUNTER IS INCREMENTED<br>·TONER EMPTY CANCEL TROUBLE THRESHOLD IS SET TO TWO<br>·DISPLAY FACT OF RECYCLED ARTICLE ON PANEL<br>·PRINTING SPEED IS SET TO ONE-THIRD SPEED |
| ALL VALUE | 00h | ·TONER CARTRIDGE IS MADE UNUSABLE |
| OTHER THAN FFh | 01h<br>~<br>FEh | ·TONER EMPTY CANCEL TROUBLE THRESHOLD IS SET TO FIVE |
| OTHER THAN FFh | FFh | ·WARNING DISPLAY |

*Fig. 5*

| FIRST NEW/OLD INFORMATION (R/W AREA) | SECOND NEW/OLD INFORMATION (OTP AREA) | PROSESSING |
|---|---|---|
| FFh | FFh | ·FIRST NEW/OLD INFORMATION IS WRITTEN TO "00h"<br>·LEAST SIGNIFICANT BIT OF SECOND NEW/OLD INFORMATION IS WRITTEN FROM "1" TO "0"<br>·NEW ARTICLE REPLACEMENT COUNTER IS INCREMENTED<br>·INITIALIZATION AND STABILIZATION OF NEW ARTICLE<br>·ATDC SENSOR INITIAL AUTOMATIC ADJUSTMENT |
| FFh | 01h<br>~<br>FEh | ·FIRST NEW/OLD INFORMATION IS WRITTEN TO "00h"<br>·LEAST SIGNIFICANT BIT OF SECOND NEW/OLD INFORMATION IS WRITTEN FROM "1" TO "0"<br>·RECYCLED ARTICLE REPLACEMENT COUNTER IS INCREMENTED<br>·INITIALIZATION AND STABILIZATION OF NEW ARTICLE<br>·ATDC SENSOR INITIAL AUTOMATIC ADJUSTMENT<br>·DISPLAY FACT OF RECYCLED ARTICLE ON PANEL<br>·PRINTING SPEED IS SET TO ONE-THIRD SPEED |
| ALL VALUE | 00h | ·DEVELOPING UNIT IS MADE UNUSABLE |
| OTHER THAN FFh | 01h<br>~<br>FEh | ·NOTHING PERFORMED |
| OTHER THAN FFh | FFh | ·WARNING DISPLAY |

IMAGE FORMING APPARATUS

RELATED APPLICATION

This application is based on Japanese Patent Application No. 2005-181874, the content of which is incorporated herein by reference.

BACKGROUND OF THE INVENTION

The present invention relates to an image forming apparatus.

Each consumption article of an image forming apparatus often has a memory that stores information peculiar to the consumption article. In the image forming apparatus, it is required to initialize and stabilize the conditions of the image forming operation in order to absorb the variation of the consumption article when the consumption article is replaced.

As described in JP H09-185236 A, some conventional image forming apparatus determine whether or not each consumption article is a new article by a value (new/old information) in a prescribed area of a memory provided on the consumption article and changes the operating conditions on the basis of the information peculiar to the consumption article stored into the memory of the consumption article or carries out new article initialization and stabilization of image forming by executing image stabilizing control such as ATDC (Auto Toner Density Control) when determining that the consumption article is a new article. Such an image forming apparatus carries out the new article initialization and stabilization and clarifies the fact that the article is not any longer a new article by rewriting the new/old information in the memory area that represents the newness and does not doubly carry out the new article initialization and stabilization until the consumption article is replaced by another consumption article. The new article information of the conventional consumption article is often written in a once rewritable area(one-time area) of the memory.

In recent years, there has been a growing demand for recycling the consumption articles in consideration of the environment and so on. For example, if a toner cartridge in which the toner has completely been consumed is filled with toner, the cartridge can be reused. However, since mechanical parts like the drive mechanism of the toner feed screw wear out, the quality of an image to be formed gradually deteriorates after repetitive recycling. Because of the operating lives of the mechanical parts, it is desirable to dispose of the toner cartridge that has undergone a specified times of recycling without recycling. As described above, it is desired to manage the times of recycling of the consumption articles.

SUMMARY OF THE INVENTION

An object of the present invention is to provide a consumption article of an image forming apparatus capable of appropriately managing the number of times of recycling and an image forming apparatus capable of appropriately managing the recycling of the consumption article.

In order to achieve the object, the present invention provides an image forming apparatus, in which a consumption article can be attached to and detached from a main body, the apparatus including a controller, which reads first new/old information that is stored in a repetitively rewritable area of a memory provided on the consumption article and represents whether or not the consumption article is unused after manufacturing or after recycling and second new/old information that is stored in a once rewritable area of the memory and represents the number of times of recycling of the consumption article, and which controls the operation of the image forming apparatus on the basis of the first new/old information and the second new/old information.

According to the construction, the controller is able to initialize the image forming apparatus by detecting the fact that the consumption article has been replaced according to the first new/old information and appropriately distinguish whether or not the consumption article has been recycled in excess of the mechanical operating life according to the second new/old information. Since the first new/old information is stored in the repetitively rewritable area of the memory, the consumption article can the recycled without replacing the memory. Since the second new/old information is stored in the once rewritable area of the memory, it is not concerned that the second new/old information is erroneously reduced, and it is possible to appropriately distinguish whether or not the consumption article has been recycled in excess of the mechanical operating life.

Moreover, in the image forming apparatus of the present invention, if the controller rewrites the first new/old information to a value that represents a non-unused state and rewrites the second new/old information to a value that represents a one greater number of times of recycling when the first new/old information represents the unused state, the image forming apparatus updates the second new/old information of the consumption article. Therefore, it is not required to update the second new/old information by manual operation in recycling the consumption article. This therefore prevents the user from forgetting about updating the second new/old information, and the number of times of recycling of the consumption article can reliably be counted.

Moreover, in the image forming apparatus of the present invention, if the controller carries out prescribed initialization when the first new/old information represents the unused state, it is possible to detect the replacing the consumption article, absorb the variation of the consumption article and carry out appropriate image forming.

Moreover, in the image forming apparatus of the present invention, the controller may change a criterion (e.g., the number of trials until determining that the toner empty cannot be canceled due to a mechanical failure) for determining a toner empty cancel failure according to contents of the first new/old information. If the user has not replaced the toner cartridge or has mounted the toner cartridge that is not unused in the case of toner empty, it is possible that the toner empty is not canceled even if no abnormality is occurring in the image forming apparatus. Accordingly, by alleviating the criterion for determining that the toner empty cancel failure is occurring when the consumption article is not unused, or for example, by increasing the setting number of trials until determining that the toner empty is occurring, the toner empty cancel failure can be prevented from being misconceived.

Moreover, it is acceptable that the image forming apparatus of the present invention further includes a new article replacement counter that counts the number of times of replacing the consumption article by a new article and a recycled article replacement counter that counts the number of times of replacing the consumption article by a recycled article, and the controller increments by one the new article replacement counter if the second new/old information represents zero times of recycling when the first new/old information represents an unused state and increments by one the recycled article replacement counter if the second new/old information represents one or more times of recycling when the first new/old information represents the unused state. With this arrangement, the user or a service personnel can know the history of the degree of use of new articles and recycled articles by the image forming apparatus, and this can be referred to for specifying the cause at the time of trouble and for the setting of parameters.

Moreover, in the image forming apparatus of the present invention, the controller may display on a display part the fact that the consumption article is not the new article on the display part if the second new/old information represents one or more times of recycling when the first new/old information represents the unused state, by which the user can confirm whether or not the mounted (replaced) consumption article is a new article or a recycled article.

Moreover, in the image forming apparatus of the present invention, the controller may change the speed of image forming according to contents of the second new/old information, by which it is possible to reduce the speed of image forming in accordance with the wearout of the durable components that are not replaced when the consumption article is recycled and maintain the quality of the image to be formed.

Moreover, in the image forming apparatus of the present invention, if the controller changes the contents of image stabilization control according to the contents of the second new/old information, the image stabilization control can be optimized in accordance with the wearout of the durable components that are not replaced when the consumption article is recycled.

Moreover, the present invention provides a consumption article capable of being attached to an image forming apparatus, the consumption article including a memory that is accessible from the image forming apparatus when mounted on the image forming apparatus. The memory has a first repetitively rewritable area storing first new/old information that represents whether or not the consumption article is unused after manufacturing or after recycling and a once rewritable area storing second new/old information that represents the number of times of recycling of the consumption article.

According to the construction, it can be confirmed that the consumption article is a new article or used for the first time after recycling by the first new/old information, and it can be determined whether or not the initialization of the image forming apparatus is required. Moreover, the pros and cons of the recycling can be appropriately determined by perceiving the number of times of recycling of the consumption article according to the second new/old information. Since the first new/old information is stored in the repetitively rewritable area of the memory, the recycling can be achieved without replacing the memory. Since the second new/old information is stored in the once rewritable area of the memory, it is not concerned that the second new/old information is erroneously reduced, and it can be appropriately expressed whether or not the article is recycled in excess of the mechanical operating life.

Moreover, the control method of the present invention is a control method to be executed in an image forming apparatus in which a consumption article can be attached to and detached from a main body, the method comprising the steps of:

making an access to a memory provided on the consumption article to read first new/old information that is stored in a repetitively rewritable area of the memory and represents whether or not the consumption article is unused after manufacturing or after recycling and second new/old information that is stored in a once rewritable area of the memory and represents the number of times of recycling of the consumption article; and controlling the operation of the image forming apparatus on the basis of the read first new/old information and second new/old information.

According to the control method of the present invention, it is acceptable to rewrite the first new/old information to a value that represents a non-unused state and rewrite the second new/old information to a value that represents a one greater number of times of recycling, when the first new/old information represents the unused state, in the control step.

Moreover, according to the control method of the present invention, prescribed initialization may be executed when the first new/old information represents the unused state in the control step.

Moreover, according to the control method of the present invention, a criterion for determining a toner empty cancel failure may be changed according to contents of the first new/old information in the control step.

Moreover, according to the control method of the present invention, it is acceptable to increment by one the counter value that represents the number of times of replacing the consumption article by a new article if the second new/old information represents zero times of recycling when the first new/old information represents an unused state, and increment by one the counter value that represents the number of times of replacing the consumption article by a recycled article if the second new/old information represents one or more number of times of recycling when the first new/old information represents the unused state in the control step.

Moreover, according to the control method of the present invention, it is acceptable to display the fact that the consumption article is not a new article on a display part if the second new/old information represents one or more times of recycling when the first new/old information represents the unused state in the control step.

Moreover, according to the control method of the present invention, it is acceptable to change the speed of image forming of the image forming apparatus according to the contents of the second new/old information in the control step.

Moreover, according to the control method of the present invention, it is acceptable to change the contents of the image stabilization control of the image forming apparatus according to contents of the second new/old information in the control step.

According to the present invention, a consumption article capable of being attached to and detached from an image forming apparatus has a memory that is accessible from the image forming apparatus when the consumption article is attached to the image forming apparatus. The memory includes a repetitively rewritable area storing a first new/old information that represents whether or not the consumption article is unused after manufacturing or after recycling and a once rewritable area storing second new/old information that represents a number of times of recycling of the consumption article. Therefore, the image forming apparatus is able to carry out initialization by detecting the time of replacing the consumption article and appropriately determine the limit of the recycling by detecting the number of times of recycling.

BRIEF DESCRIPTION OF THE DRAWINGS

The present invention will be further described with reference to the accompanying drawings wherein like reference numerals refer to like parts in the several views, and wherein:

FIG. 3 is an address map of the toner cartridge memory of FIG. 1;

FIG. 4 is a table that represents the processes of the image forming apparatus of FIG. 1 through classification by information of the toner cartridge memory; and FIG. 5 is a table representing the processes of the image forming apparatus of FIG. 1 through classification by information of a developing unit memory.

DETAILED DESCRIPTION OF THE PREFERRED EMBODIMENTS

Figure 1:
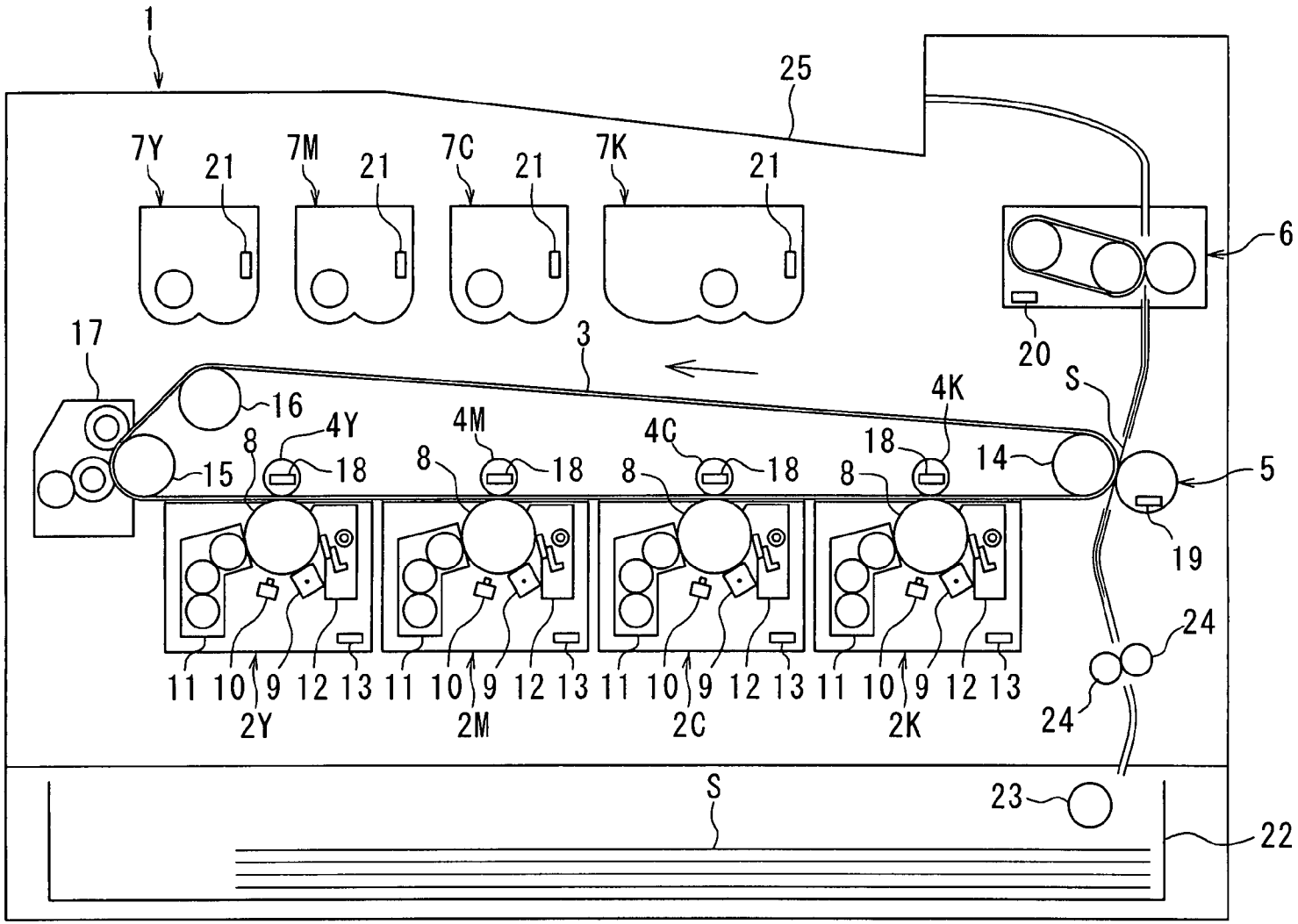
FIG. 1 a schematic diagram showing the construction of the image forming apparatus of one embodiment of the present invention.

FIG. 1 shows an image forming apparatus according to one embodiment of the present invention. The image forming apparatus has in its main body 1 four developing units (consumption articles) 2Y, 2M, 2C and 2K that form yellow, magenta, cyan and black toner images, a transfer belt 3, primary transfer units (consumption articles) 4Y, 4M, 4C and 4K that transfer toner images formed by the developing units 2Y, 2M, 2C and 2K onto the transfer belt 3 by electrostatic forces, a secondary transfer unit (consumption article) 5 that transfers the toner image transferred on the transfer belt 3 onto a recording paper S by electrostatic forces, a fixing unit (consumption article) 6 that fixes the toner image on the recording paper S by heating, and toner cartridges (consumption articles) 7Y, 7M, 7C and 7K that supply yellow, magenta, cyan and black toners to the developing units 2Y, 2M, 2C and 2K, respectively.

Each of the developing units 2Y, 2M, 2C and 2K has a rotary drum-shaped photoreceptor 8, a charger 9 that electrically charges the photoreceptor 8, an exposure unit 10 that forms an electrostatic latent image by exposing the charged photoreceptor 8 to light, a developing unit 11 that makes a toner adhere to the electrostatic latent image, a cleaner 12 that scrapes the toner off the surface of the photoreceptor 8, and a developing unit memory 13 that stores the information of the characteristics, operation conditions, and use history including new/old information that represents whether each article is used or unused and so on.

The transfer belt 3 is wound around a driving roller 14 to be driven, a free roller 15 and a tension roller 16 that applies a tension force and rotates in the direction of the arrow by the driving roller 14. The image forming apparatus is further provided with a cleaner unit 17 that removes the toner remaining on the surface of the transfer belt 3.

Each of the primary transfer units 4Y, 4M, 4C and 4K has a primary transfer unit memory 18 that stores the information of the adjustment value, use history including new/old information and so on. The secondary transfer unit 5 has a secondary transfer unit memory 19. The fixing unit 6 has a fixing unit memory 20. Each of the toner cartridges 7Y, 7M, 7C and 7K has a toner cartridge memory 21 that stores the information of the adjustment value, use history including new/old information and so on.

The recording papers S are supplied to a paper feeding part 22, fed one after another by a feed roller 23, conveyed to the secondary transfer unit 5 by a conveyance roller 24 and discharged through the fixing unit 6 to a sheet discharge part 25 at an upper portion of the main body 1.

Figure 2:
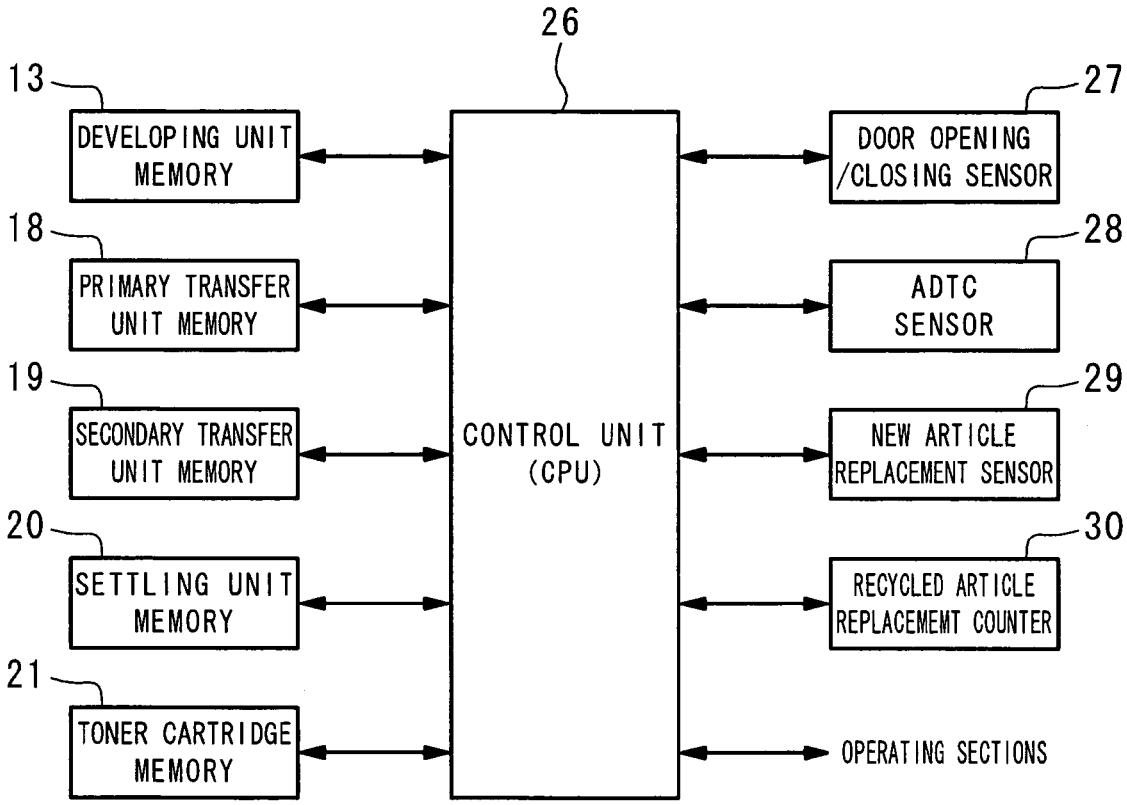
FIG. 2 is a block diagram of the constituent elements relevant to the control of the image forming apparatus of FIG. 1.

FIG. 2 shows the constituent elements relevant to the control of the image forming apparatus of the present embodiment. The image forming apparatus has a control unit (controller) 26 including a CPU and is able to read the information stored in the developing unit memory 13, the primary transfer unit memory 18, the secondary transfer unit memory 19, the fixing unit memory 20 and the toner cartridge memory 21 and rewrite the information of the memories 13, 18, 19, 20 and 21 if the memories permit the rewrite. Moreover, the control unit 26 is electrically connected to a door opening/closing sensor 27 that monitors the open/closed state of the door of the image forming apparatus, an ATDC (Auto Toner Density Control) sensor 28 for toner density automatic adjustment, a new article replacement counter 29 that counts the number of times of replacing each of the consumption articles 2Y, 2M, 2C, 2K, 4Y, 4M, 4C, 4K, 5, 6, 7Y, 7M, 7C and 7K by a new article, a recycled article replacement counter 30 that counts the number of times of replacing each of those consumption articles by a recycled article and other operating sections. The control unit 26 of the present embodiment, which carries out control by software, may be constructed of a hardware circuit.

FIG. 3 shows the address mapping of the toner cartridge memory 21 of the toner cartridges 7Y, 7M, 7C and 7K. The toner cartridge memory 21 has addresses 00 h through 3Fh, and each address can store 8-bit information. Information (data) to be stored at each address is predetermined as shown.

The toner cartridge memory 21 is constructed of storage elements of three kinds of different attributes. The addresses 00 h through 1Fh are written in a manufacturing stage and are constructed of a read-only memory (ROM area) that is not writable but only readable by the control unit 26. The addresses 20 h through 2Fh are constructed a memory (R/W area) such as a RAM that is freely rewritable by the control unit 26. The addresses 30 h through 3Fh are constructed of a one-time programmable memory (OTP area) that is once writable by the control unit 26.

Moreover, the addresses 00 h through 1Fh store a model identification code that represents the types of the toner cartridges 7Y, 7M, 7C and 7K, a color identification code that represents the color of the loaded toner, a loading weight identification code that represents the amount of the loaded toner and so on. At the addresses 20 h through 2Fh are principally written temporary information during printing (image forming) such as the number of revolutions of the toner feed screw by the control unit 26. First new/old information, which represents whether or not the toner cartridge is unused (new article) after manufacturing or unused after recycling is written at one of the addresses 20 h through 2Fh. The first new/old information represents the unused state (new article or unused after recycling) when the address is "FFh". Use history data are written at the addresses 30 h through 3Fh, and second new/old information, which represents the number of times of recycling (recycling of loading again the toner) of the toner cartridges, is stored at one of the addresses 30 h through 3Fh. The second new/old information, which has all bits set at "1" in the new article stage, is rewritten to "0" sequentially from the least significant bit by the control unit 26 every time the new article or the recycled article is used for the first time.

The control unit 26 confirms the states of the toner cartridges 7Y, 7M, 7C and 7K (and other consumption articles 2Y, 2M, 2C, 2K, 4Y, 4M, 4C, 4K, 5 and 6) every time the door opening/closing sensor 27 detects the opening/closing of the door of the main body 1. When the opening/closing of the door occurs, it is confirmed whether or not the user has replaced any one of the consumption articles (2Y, 2M, 2C, 2K, 4Y, 4M, 4C, 4K, 5, 6, 7Y, 7M, 7C and 7K). This is because, when a consumption article has been replaced, it becomes necessary to change the operation of the image forming apparatus in order to absorb the variation of the consumption article and carry out prescribed initialization.

FIG. 4 shows what processing is to be executed in accordance with the values of the first new/old information and the second new/old information of the toner cartridge memory 21 confirmed by the control unit 26 of the present embodiment when the door of the main body 1 is closed.

If the first new/old information is "FFh", then the toner cartridge is a new article unused after manufacturing or an unused article after recycling (both hereinafter referred to simply as an unused article). The toner cartridges 7Y, 7M, 7C and 7K once mounted on the image forming apparatus become not "unused" any longer, and therefore, the control unit 26 rewrites the first new/old information to "00 h (value that represents a non-unused state)". Moreover, the control unit 26 rewrites the least significant bit of the second new/old information from "1" to "0". This is because, when the first new/old information is next rewritten to "FFh (unused)", the toner cartridge 7Y, 7M, 7C or 7K is nothing but a recycled one. Therefore, preparatorily incrementing the number of times of recycling by one can prevent the occurrence of omission in counting the number of times of recycling.

Therefore, if the second new/old information is "FFh" when the first new/old information is "FFh", then the toner cartridge 7Y, 7M, 7C or 7K is a new article (unused after manufacturing). If the second new/old information is not "FFh" when the first new/old information is "FFh", then the toner cartridge 7Y, 7M, 7C or 7K is unused after recycling. If the mounted toner cartridge 7Y, 7M, 7C or 7K is unused after recycling, the control unit 26 displays the fact that the toner cartridge 7Y, 7M, 7C or 7K is a recycled article on a display part (not shown) of the image forming apparatus. This is to inform the user of the fact that the recycled article is in use since the recycled article sometimes causes a reduction in the quality of the image to be formed due to the wearout of the mechanical components that are not replaced. It is noted that the displayed contents are only required to be a display for informing the user of the fact that it is not a new article. A display for urging the user to pay attention to the quality of the image may be displayed besides the fact that it is a recycled article.

Moreover, since the second new/old information is rewritten to "0" from the least significant bit, the number of times of recycling can be distinguished as one when the second new/old information is "FEh", two when the information is "FCh", three when the information is "F8h" and four when the information is "F0 h" and so on. When the second new/old information is "00 h" (the number of times of recycling is eight), the control unit 26 determines that the toner cartridge 7Y, 7M, 7C or 7K has been recycled in excess of the operating life, inhibits the use of the toner cartridge 7Y, 7M, 7C or 7K and displays an error indication on the display part. Since the second new/old information is previously rewritten when an unused toner cartridge 7Y, 7M, 7C or 7K is mounted, the image forming apparatus substantially permits the recycling seven times.

The control unit 26 increments (adding by one) the value of the new article replacement counter 29 when it detects that the first new/old information is "FFh" and the second new/old information is "FFh" and increments (adding by one) the value of the recycled article replacement counter 30 when it detects that the first new/old information is "FFh" and the second new/old information is not smaller than "01h" and not greater than "FFh". By this operation, the user or the service personnel can know the history that represents the degree of use of the new articles and the recycled articles by the image forming apparatus, and this can be referred to for specifying the cause at the time of trouble and for the setting of parameters.

When the control unit 26 detects toner empty and stops the operation of the image forming apparatus, the user is required to open the door of the main body 1 and replace the toner cartridge 7Y, 7M, 7C or 7K. When the toner cartridge 7Y, 7M, 7C or 7K is replaced by an unused one, the toner empty is to be immediately canceled. However, if the toner empty is not canceled despite that the unused toner cartridge 7Y, 7M, 7C or 7K is mounted continuously two times (toner empty cancel trouble threshold), it is suspected that some trouble is occurring, and therefore, it is treated as a trouble (e.g., a display for requesting making contact with the service center). However, the user sometimes tries a recovery by closing the opened door without replacing the toner cartridge 7Y, 7M, 7C or 7K or tries a recovery by mounting a toner cartridge 7Y, 7M, 7C or 7K that is not unused. In such a case, the toner empty is not canceled or a time is required until the cancel even if the image forming apparatus is normal. In order to permit such an action by the user, the control unit 26 determines that the toner cartridge 7Y, 7M, 7C or 7K has not been replaced so long as the first new/old information is not "FFh" and sets the number of trials (toner empty cancel trouble threshold) until processing it as a trouble to, for example, five times.

Moreover, when the second new/old information is not greater than "FEh", i.e., when the toner cartridge 7Y, 7M, 7C or 7K is a recycled article, the control unit 26 sets the printing speed to, for example, one-third speed. This is because the toner feed ability is reduced due to the factors of the wearout of the mechanical components and the like when the toner cartridge 7Y, 7M, 7C or 7K is a recycled article, but an image of a quality similar to that of a new article can be obtained by reducing the printing speed. It is also acceptable to substantially reduce the image forming speed by avoiding continuous printing by expanding the paper feed interval, temporarily stopping the operation every time a prescribed number of prints are made or taking a similar measure other besides the reduction in the printing speed (system speed).

It is a matter of course that new toner cartridges 7Y, 7M, 7C and 7K are shipped with the first new/old information set to "FFh" and the second new/old information set to "FFh". When a new toner cartridge 7Y, 7M, 7C or 7K is first mounted on the image forming apparatus, the first new/old information is rewritten to "00 h" and the second new/old information is rewritten to "FEh". Therefore, it cannot be considered that the second new/old information is "FFh" despite that the first new/old information is not "FFh". In such a case, the control unit 26 determines that an abnormality is occurring in the toner cartridge 7Y, 7M, 7C or 7K, inhibits the use and issues a warning display.

FIG. 5 shows what kind of processing is to be executed in accordance with the values of the first new/old information and the second new/old information of the developing unit memory 13 confirmed by the control unit 26 when the door opening/closing sensor 27 detects the opening/closing of the door of the main body 1. The rewriting of the first new/old information and the second new/old information, the increments of the new article replacement counter and the recycled article replacement counter, a change in the printing speed and so on are the same as the processing of the toner cartridge memory 21 of FIG. 4.

When an unused developing unit 2Y, 2M, 2C or 2K is mounted, i.e., when the first new/old information of the developing unit memory 13 is "FFh", the control unit 26 carries out a self-diagnosis of the internal state of the apparatus with a sensor and carries out initialization and stabilization of a new article by changing the voltage of the charger 9 for electrically charging the photoreceptor 8, the quantity of laser light of the exposure 10 and so on in order to secure the gradation reproducibility of the image to be formed. Moreover, the control unit 26 also carries out calibration (initial automatic adjustment) of the ATDC sensor 28 at this time. The initialization and stabilization of the new article and the initial automatic control of the ATDC sensor 28 are carried out even when the developing unit 2Y, 2M, 2C or 2K is a new article (second new/old information is "FFh") or a recycled article (second new/old information is "01h" through "FEh").

When the developing unit 2Y, 2M, 2C or 2K is not unused, i.e., when the first new/old information of the developing unit memory 13 is not "FFh", the control unit 26 carries out no special processing. Moreover, the point that the control unit 26 inhibits the use of the developing unit 2Y, 2M, 2C or 2K and issues a warning display when the first new/old information is not "FFh" and the second new/old information is "FFh" is similar to that carried out for the toner cartridge 7Y, 7M, 7C or 7K of FIG. 4.

The processing based on the first new/old information and the second new/old information of the toner cartridge 7Y, 7M, 7C or 7K and the processing based on the first new/old information and the second new/old information of the developing unit 2Y, 2M, 2C or 2K have been described above. However, the control unit 26 is also able to similarly store the first new/old information and the second new/old information for the memories 18, 19 and 20 of the other consumption articles 4Y, 4M, 4C, 4K, 5 and 6 and carry out processing on the. basis of the first new/old information and the second new/old information.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus in which a consumption article can be attached to and detached from a main body, the apparatus comprising:

a controller, which reads first new/old information that is stored in a repetitively rewritable area of a memory provided on the consumption article and represents whether or not the consumption article is unused after manufacturing or after recycling and second new/old information that is stored in a once rewritable area of the memory and represents a number of times of recycling of the consumption article, and which controls operation of the image forming apparatus on the basis of the first new/old information and the second new/old information.

2. The image forming apparatus as claimed in claim 1, wherein the controller rewrites the first new/old information to a value that represents a non-unused state and rewrites the second new/old information to a value that represents a one greater number of times of recycling when the first new/old information represents the unused state.

3. The image forming apparatus as claimed in claim 1, wherein the controller executes prescribed initialization when the first new/old information represents the unused state.

4. The image forming apparatus as claimed in claim 1, wherein the controller changes a criterion for determining a toner empty cancel failure according to contents of the first new/old information.

5. The image forming apparatus as claimed in claim 1, wherein the apparatus further comprises a new article replacement counter that counts a number of times of replacing the consumption article by a new one and a recycled article replacement counter that counts a number of times of replacing the consumption article by a recycled one, and the controller increments by one the new article replacement counter if the second new/old information represents zero times of recycling when the first new/old information represents an unused state and increments by one the recycled article replacement counter if the second new/old information represents one or more times of recycling when the first new/old information represents the unused state.

6. The image forming apparatus as claimed in claim 1, wherein the controller displays on a display part a fact that the consumption article is not a new article if the second new/old information represents one or more times of recycling when the first new/old information represents the unused state.

7. The image forming apparatus as claimed in claim 1, wherein the controller changes a speed of image forming according to contents of the second new/old information.

8. The image forming apparatus as claimed in claim 1, wherein the controller changes contents of image stabilization control according to contents of the second new/old information.

9. A control method to be executed in an image forming apparatus in which a consumption article can be attached to and detached from a main body, the method comprising the steps of:

making an access to a memory provided on the consumption article to read first new/old information that is stored in a repetitively rewritable area of the memory and represents whether or not the consumption article is unused after manufacturing or after recycling and second new/old information that is stored in a once rewritable area of the memory and represents a number of times of recycling of the consumption article; and controlling operation of the image forming apparatus on the basis of the read first new/old information and second new/old information.

10. The control method as claimed in claim 9, wherein the first new/old information is rewritten to a value that represents a non-unused state and the second new/old information is rewritten to a value that represents a one greater number of times of recycling, when the first new/old information represents the unused state, in the control step.

11. The control method as claimed in claim 9, wherein prescribed initialization is executed when the first new/old information represents the unused state in the control step.

12. The control method as claimed in claim 9, wherein a criterion for determining a toner empty cancel failure is changed according to contents of the first new/old information in the control step.

13. The control method as claimed in claim 9, wherein a counter value that represents a number of times of replacing the consumption article by a new one is incremented by one if the second new/old information represents zero times of recycling when the first new/old information represents an unused state, and a counter value that represents a number of times of replacing the consumption article by a recycled one is incremented by one if the second new/old information represents one or more times of recycling when the first new/old information represents the unused state in the control step.

14. The control method as claimed in claim 9, wherein a fact that the consumption article is not a new article is displayed on a display part if the second new/old information represents one or more times of recycling when the first new/old information represents the unused state in the control step.

15. The control method as claimed in claim 9, wherein a speed of image forming of the image forming apparatus is changed according to contents of the second new/old information in the control step.

16. The control method as claimed in claim 9, wherein contents of image stabilization control of the image forming apparatus are changed according to contents of the second new/old information in the control step.

17. A consumption article capable of being attached to and detached from an image forming apparatus, the consumption article comprising:

a memory that is accessible from the image forming apparatus when the consumption article is attached to the image forming apparatus, wherein the memory has a repetitively rewritable area storing first new/old information that represents whether or not the consumption article is unused after manufacturing or after recycling and a once rewritable area storing second new/old information that represents a number of times of recycling of the consumption article.

* * * * *